United States Patent [19]

Tromp

[11] 4,257,131

[45] Mar. 24, 1981

[54] DEVICE TO APPLY A PAPER SHEET TO A CLOSET SEAT

[76] Inventor: Gerardus M. Tromp, Van Alkemadelaan 1132, The Hague, Netherlands

[21] Appl. No.: 52,950

[22] Filed: Jun. 27, 1979

[51] Int. Cl.[3] ..... A47K 13/14; A47K 13/16

[52] U.S. Cl. ..... 4/246; 4/243; 4/244

[58] Field of Search ..... 4/244, 246, 242, 243; 221/186, 188, 210, 245, 259, 277

[56] References Cited

U.S. PATENT DOCUMENTS

| | | | |
|---|---|---|---|
| 1,376,926 | 5/1921 | Fisher | 4/246 |
| 3,693,198 | 9/1972 | Tromp | 4/246 |
| 4,203,530 | 5/1980 | Tromp | 4/246 X |

FOREIGN PATENT DOCUMENTS

| | | | |
|---|---|---|---|
| 62702 | 12/1890 | Fed. Rep. of Germany | 4/246 |
| 2438932 | 4/1976 | Fed. Rep. of Germany | 4/244 |
| 1029610 | 6/1953 | France | 4/244 |

*Primary Examiner*—Henry K. Artis

*Attorney, Agent, or Firm*—Finnegan, Henderson, Farabow, Garrett & Dunner

[57] ABSTRACT

A device for applying a paper sheet to a toilet seat which includes a paper sheet container adapted to move from a substantially vertical position to a position over the toilet seat, and then back to a substantially vertical position by manually operating a tilting mechanism. A rotatable roller is positioned in the container and is driven to feed a paper sheet into position on the toilet seat as the container undergoes return movement from its position over the toilet seat back to its substantially vertical position.

11 Claims, 10 Drawing Figures

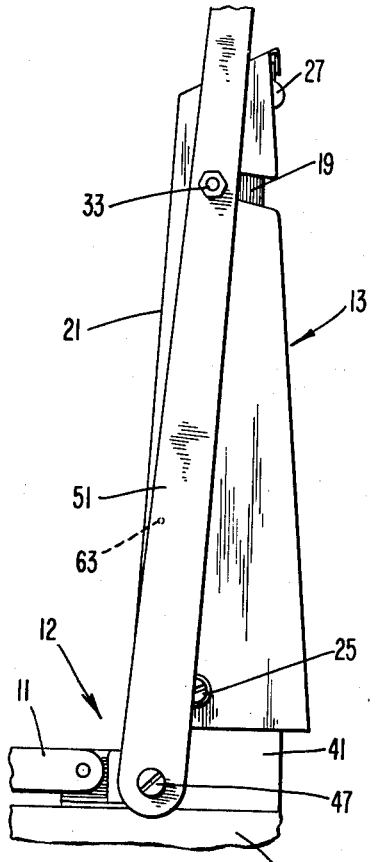
Fig. 3
Fig. 4
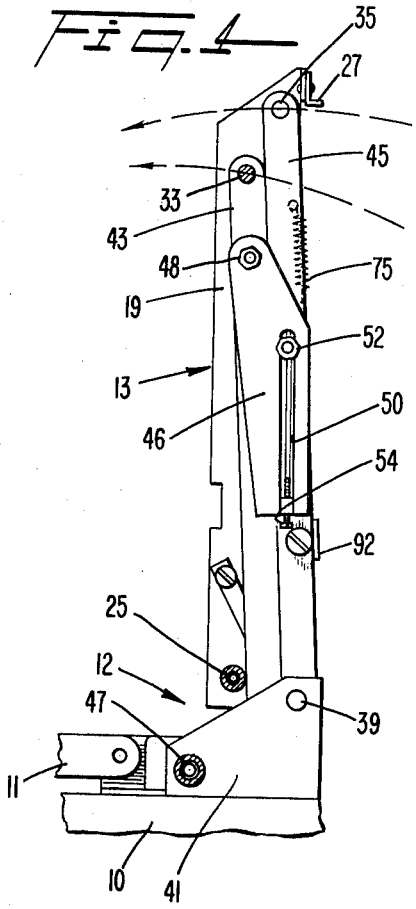
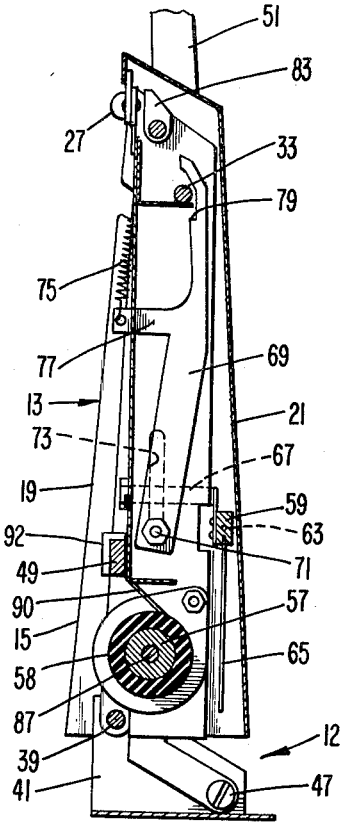
Fig. 5
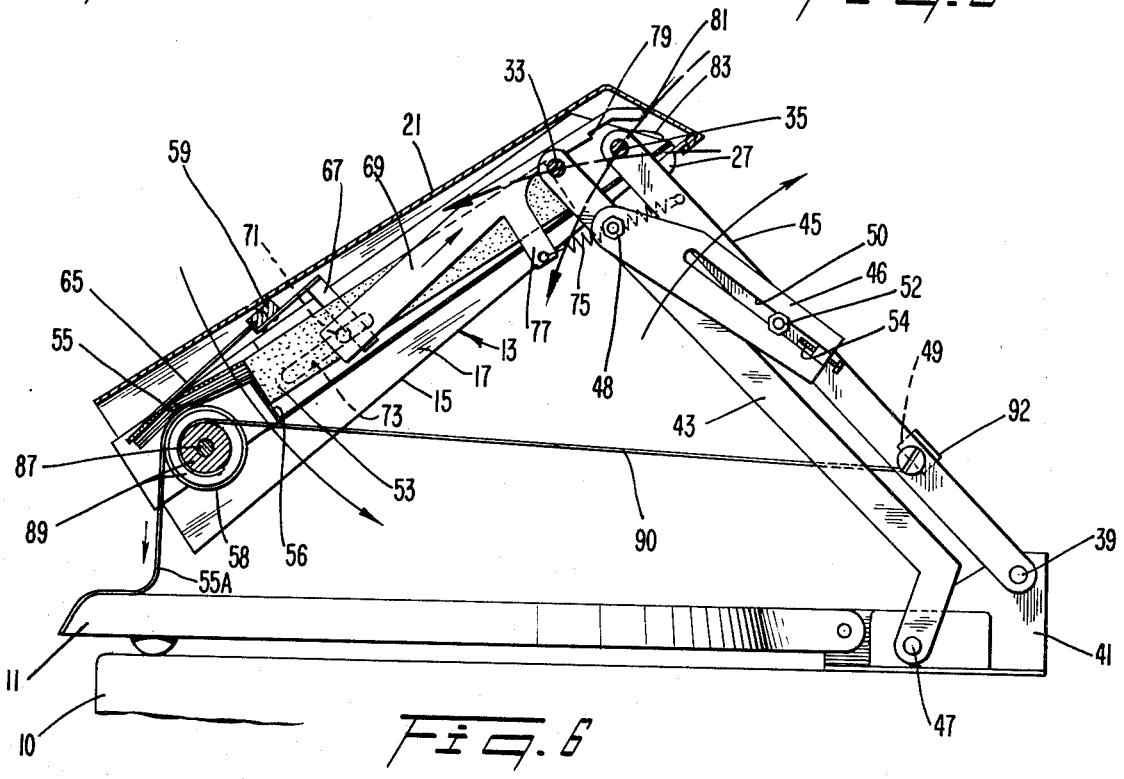
Fig. 6

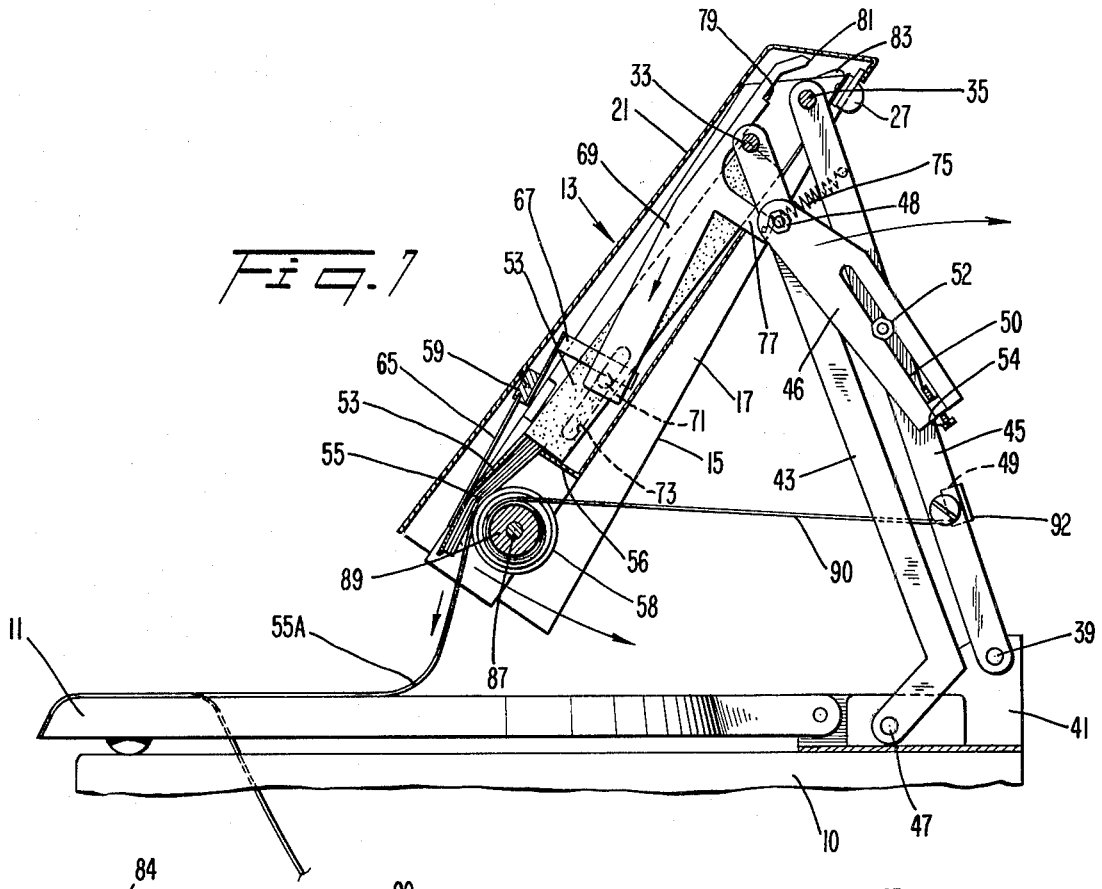
Fig. 7
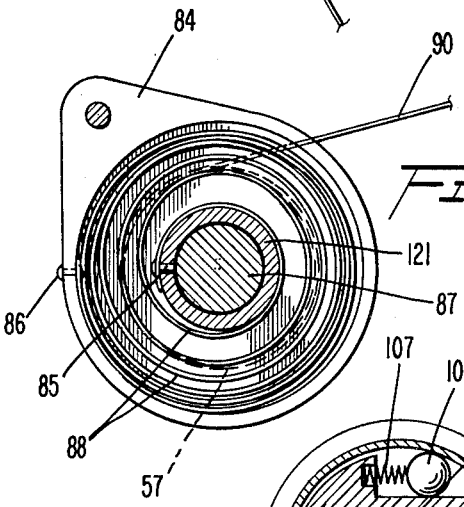
Fig. 9
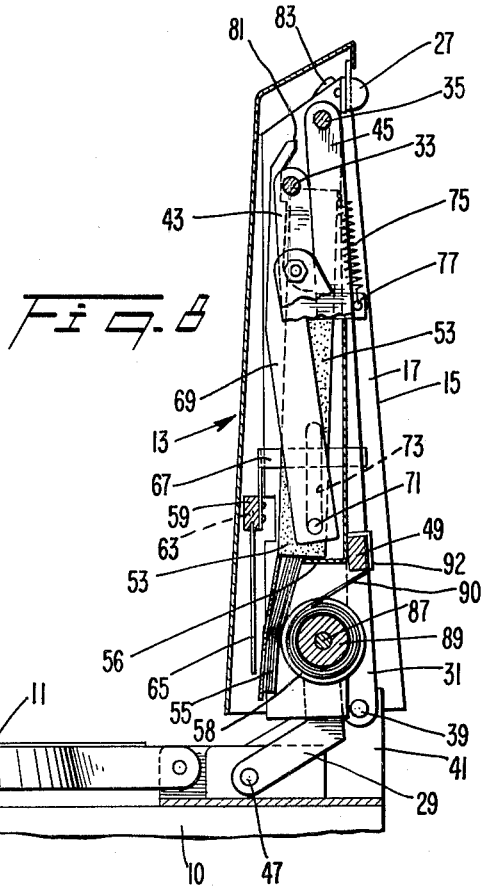
Fig. 8
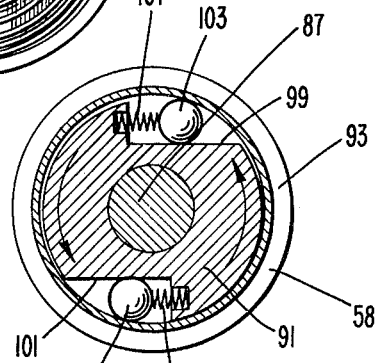
Fig. 10
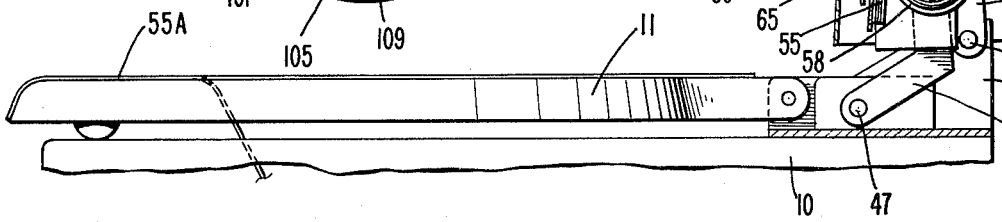

DEVICE TO APPLY A PAPER SHEET TO A CLOSET SEAT

FIELD OF THE INVENTION

This invention relates to devices for applying paper sheets to toilet seats.

BACKGROUND OF THE INVENTION

Tromp U.S. Pat. No. 3,693,198 discloses a toilet seat provided with a clamping strip rotatable between a clamping position and a rest position. In the vertical position of the seat, the strip can clamp the paper sheet from a stock of paper sheets and carries the sheet along when the seat is moved to the horizontal position. Both the rotatable strip and the toilet seat are operated by the same control lever.

It is considered a disadvantage that an essential part of the device, namely, the rotatable clamping strip is journaled in the toilet seat itself. Besides, this device is complicated and costly.

Applicant's copending application Ser. No. 886,600, filed Mar. 14, 1978, is directed to an improvement over Tromp U.S. Pat. No. 3,693,198. In applicant's copending application, the device disclosed can operate fully independently of the toilet seat and can be used with toilet seats of standard construction. That device comprises a box-shaped container which holds a supply of paper sheets fitting the toilet seat, and is mounted adjacent thereto. A tilting mechanism is provided to which the container is pivotally secured so that when the tilting mechanism is operated, the container tilts and hinges from a vertical position to a substantially horizontal position over the toilet seat. A paper-driving roller is journaled inside the container, and a driving mechanism rotates the roller in one direction when the container moves from its substantially vertical position to its substantially horizontal position over the toilet seat.

The device disclosed in applicant's copending application represents a significant improvement over the prior art. However, that device contains certain disadvantages for the reason that a paper sheet is biased into engagement with the paper-conveying roller at all times, even when the device is not in use, and can result in the paper sheet sticking to the roller and resulting malfunction of the device. Furthermore, applicant's prior device includes a relatively large number of parts adding to its size, complexity, cost, and increasing the possibility of failure or malfunction.

SUMMARY OF THE INVENTION

The present invention, like applicant's prior invention described in his copending application, is a device for applying a paper sheet to a toilet seat which operates wholly independently of the toilet seat and can be used with a variety of toilet seats of standard construction. Further, this invention provides an improvement over applicant's prior invention in that it greatly reduces or eliminates the likelihood that a paper sheet can stick to the paper conveying roller, and further significantly reduces the required number of parts and correspondingly the size, complexity, cost, and likelihood of malfunction or failure of the device.

Additional objects and advantages of the invention will be set forth in part in the description which follows, and in part will be obvious from the description, or may be learned by practice of the invention. The objects and advantages of the invention may be obtained by means of the instrumentalities and combinations pointed out in the appended claims.

To achieve the objects and in accordance with the purposes of the invention, as embodied and broadly described herein, the device for applying a paper sheet to a toilet seat comprises a container holding a stacked supply of paper sheets fitting the toilet seat, means supporting the container adjacent the toilet seat and including a mechanism operable to move the container from a substantially vertical position rearwardly of the toilet seat to a position over the seat, a paper sheet feeding roller journaled on the container, drive means interconnected with the support means and operable to rotate the roller during at least a portion of the movement of the container, means operable to press a paper sheet from the stacked supply against the paper sheet-feeding roller during that portion of container movement when the paper sheet is delivered from the container and applied to the toilet seat, and means responsive to the position of the support means holding the paper sheet press means out of pressing engagement with the paper sheets when the container is in its substantially vertical position.

In another aspect, the invention comprises a container holding a stacked supply of sheets fitting the toilet seat, means supporting the container adjacent the toilet seat and including a mechanism operable to move the container from a substantially vertical position rearwardly of the toilet seat to a position tilted and hinged downwardly and forwardly over the toilet seat, a paper sheet feeding roller journaled on the container, drive means interconnected with the support means and operable to rotate the roller only during return movement of the container from its position over the toilet seat to its substantially vertical position, means in the container operable to bias a paper sheet from the stacked supply against the roller during rotation thereof, and means responsive to the position of the support means preventing biased operative engagement of the press means with the paper sheet during other movement of the container and when the container is in its substantially vertical position.

In a preferred embodiment, a free wheel coupling for the paper sheet-feeding roller is interconnected with the tilting mechanism so that when the container moves from its substantially vertical position to its position over the toilet seat, no driving motion of the feeding roller occurs. The coupling is constructed to rotate the paper sheet feeding roller during return movement of the container from the position over the toilet seat back to the substantially vertical position and causes a paper sheet to be delivered through an opening in the container during this portion of its movement. An appropriate driving mechanism for the roller may be a belt or chain running over a pulley connected to the paper sheet-feeding roller by way of the free wheel coupling. The paper sheet emerges gradually from the container as the latter tilts back toward its substantially vertical position and lands upon the toilet seat. The sheet is provided with a central portion which hangs downwardly into the toilet bowl, so that when the toilet is flushed, the paper sheet is carried off.

In the preferred embodiment, the moving or tilting mechanism is formed by two pairs of tilting links mounted on either side of the paper container, each of the links having a separate pivotal connection with the container. The pivotal connection between the container and the tilting links of each pair follow intersecting paths, as a result of which tilting motion of the container from the substantially vertical position to the position over the toilet seat is brought about.

The paper sheet press means functions to insure correct contact of the stacked paper sheets with the sheet feeding roller but does not remain in operative pressing engagement with a paper sheet when the device is not in use. In the preferred embodiment, the sheet-pressing means includes a skirt positioned on the other side of the stacked paper sheets from the paper sheet-feeding roller and resiliently biased toward the roller. The skirt is out of biased engagement with the stacked paper sheets when the container is in its substantially vertical position but resiliently presses the paper stack against the sheet-feeding roller substantially during the time the container is moving from its position over the toilet seat back to its substantially vertical position.

A paper sheet is pressed into engagement with the paper sheet-feeding roller at the time the sheet is to be delivered from the container and placed on the toilet seat and is not pressed into engagement therewith at other times particularly while the container is stored in its vertical position behind the toilet seat. This greatly reduces the likelihood that a paper sheet will stick to the sheet-feeding roller and cause the device to malfunction.

The accompanying drawings which are incorporated in and constitute part of this specification illustrate an embodiment of this invention, and, together with the description, serve to explain the principles of the invention.

BASE DESCRIPTION OF THE DRAWINGS

FIG. 3 is a side view of a portion of FIG. 1 looking in the direction of arrows 3—3;

FIG. 4 is a sectional view of FIG. 2 taken along the line 4—4;

FIG. 5 is a sectional view of FIG. 1 taken along the line 5—5;

FIG. 6 is a sectional view showing the position of the parts when the container first begins movement from its position over the toilet seat toward its substantially vertical position and a paper sheet first begins to emerge from the container;

FIG. 7 is a view similar to FIG. 6 and showing the position of the parts as the container continues its movement toward the substantially vertical position and the paper sheet continues to emerge from the container;

FIG. 8 is a view similar to FIGS. 6 and 7 and showing the position of the parts when the container is returned completely to its substantially vertical position and the paper sheet is fully emerged from the container;

FIG. 9 is an enlarged sectional view taken along the line 9—9 of FIG. 2 showing the paper sheet-feeding roller of the present invention; and FIG. 10 is an enlarged sectional view taken along the line 10—10 of FIG. 2.

DETAILED DESCRIPTION

Figure 1:
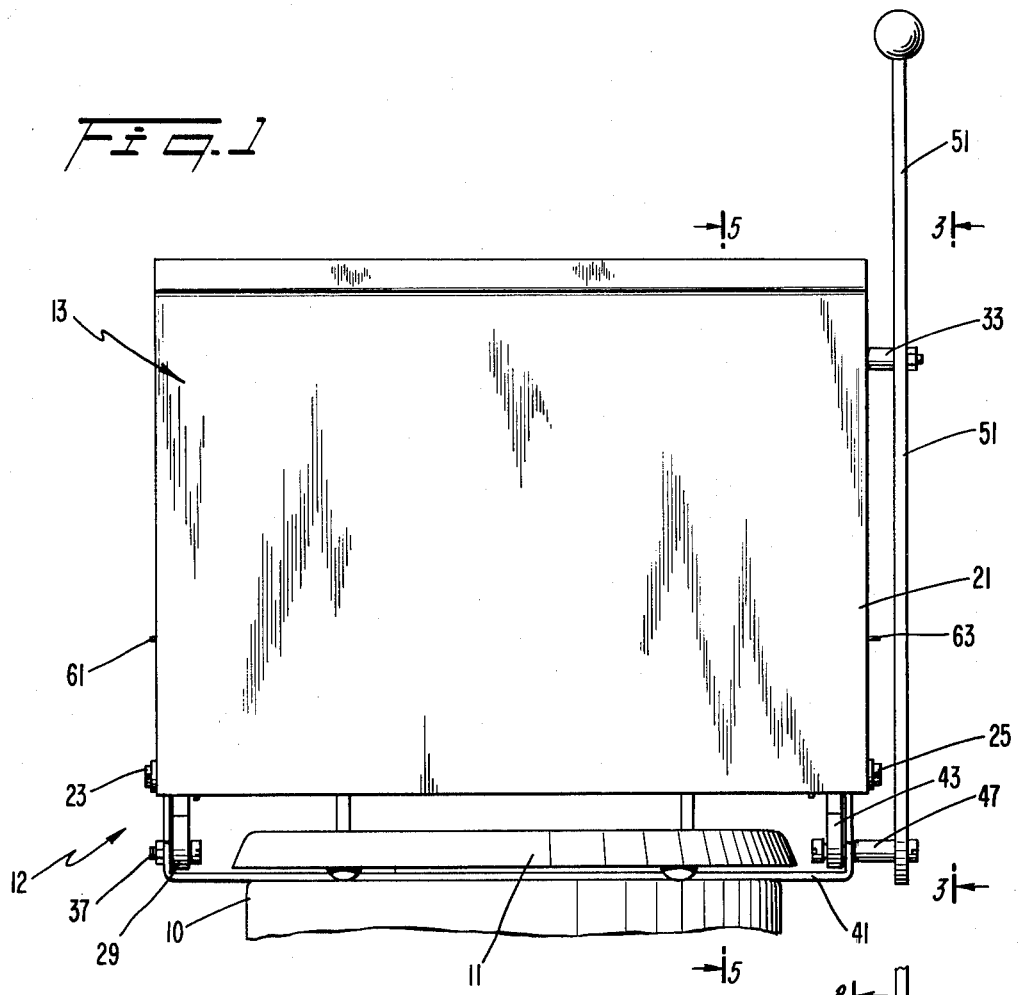
FIG. 1 is a front elevational view of a preferred form of device constructed according to the present invention and shown in the non-operated or stored position where the paper container is in a substantially vertical position.

Referring now specifically to the drawings, a device for applying a paper sheet to a tiolet seat in accordance with the present invention is seen in FIGS. 1-5 to include a container 13 supported adjacent the rear of a toilet seat 11 by a support means 12. The support means 12 can be secured to a toilet bowl 10, or to the floor or a wall adjacent the bowl. As embodied herein, the container 13 includes a frame 15 having side walls 17, 19, and a front cover 21 pivoted to the side walls by pivot pins 23, 25. A latch 27 on the frame 15 releasably retains the cover 21 in a closed position as shown in the figures.

In accordance with the invention, support means 12 includes a mechanism operable to move container 13 from a substantially vertical position rearwardly of the toilet seat 11, to a position over the toilet seat. As embodied herein, a first pair of tilting links 29, 31 is pivotally secured at one end to the frame wall 17 by pivot rods 33, 35, and at their other ends are pivotally secured by pivot pin 37, and pivot rod 39, respectively, to a U-shaped frame member 41 supported upon or adjacent the toilet bowl 10 (See FIGS. 2, 6-8). A second pair of tilting links 43, 45 are similarly pivotally connected to frame wall 19 by the pivot rods 33, 35, and to frame member 41 by pivot pin 47 and the pivot rod 39 (See also FIG. 4). For stability, the tilting links 31, 45 are interconnected by a strut 49 (FIGS. 5-8).

The container moving mechanism further includes a control lever 51 which has one end pivoted to frame member 41 through pivot pin 47 and is connected at its other end to tilting links 43 and 29 by pivot rod 33. By moving the control lever 51 forwardly, or counterclockwise as viewed in FIG. 3, the tilting links 29, 31, 43, 45 also pivot in the same direction relative to the frame member 41. The hinged connecting points between the tilting links and the container frame 15 (pivot rods 33, 35) follow the intersecting circular paths marked with dot-dash lines in FIGS. 4 and 6.

As the control lever 51 and the tilting links 29, 31, 43, 45 pivot, the container 13 tilts downwardly and forwardly from the substantially vertical position as shown in FIGS. 3 and 8, to a position over the toilet seat 11 substantially as shown in FIG. 6. When the control lever 51 and the tilting rods 29, 31, 43, 45 pivot back in a rearward direction, or clockwise as viewed in FIG. 3, the container 13 tilts upwardly from the position over the toilet seat 11 and returns to the substantially vertical position shown in FIGS. 3 and 8, via the intermediate position shown in FIG. 7.

An arm 46 is pivoted on link 43 by a pin 48 and has a slot 50 which receivesa pin 52 on link 45. The slot 52 is closed by an adjustable screw 54 which engages pin 52 to limit the allowed tilting movement for container 13.

Figure 2:
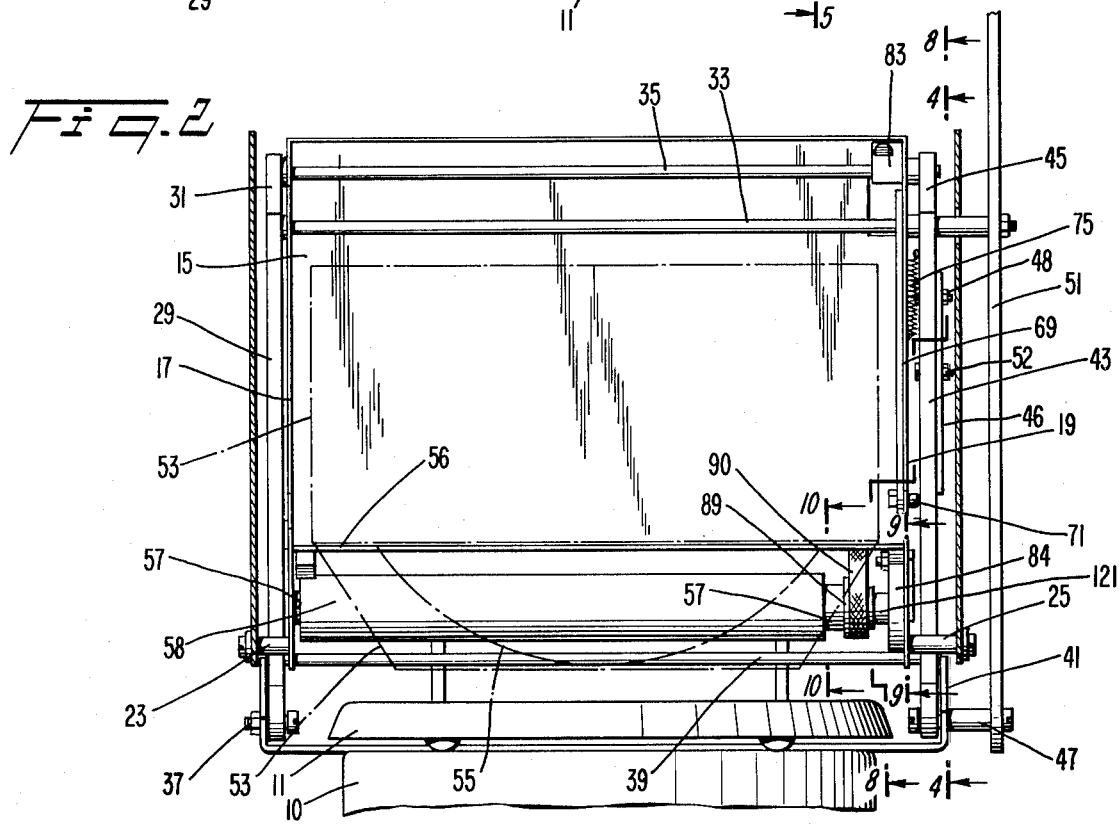
FIG. 2 is a view similar to FIG. 1 with the front cover broken away.

In accordance with the invention, the container 13 holds a stacked supply of paper sheets fitting the toilet seat 11. As embodied herein, a magazine 53 containing a stack of paper sheets 55 which fit the toilet seat 11 is held in the container 13 and is supported on a ledge 56. The sheets 55 are folded in the magazine 53 and have one end which protrudes from the magazine 53 and hangs down below ledge 56 (FIGS. 2, 7 and 8).

In accordance with the invention, a paper sheet-feeding roller is journaled on the container 13, and drive means interconnected with support means 12 rotates the roller during at least a portion of the movement of the container. As embodied herein, a paper sheet-feeding roller 57 having an outer friction surface 58 is rotatably supported at opposite ends by internal bearings (not shown). A shaft 87 passing through the roller 57 and bearings is secured to the side walls 17, 19 of the container frame 15. A pulley 89 is journaled on the shaft 87 near one end of the roller 57 and has a short tubular extension 121 extending from one side and passing into a spring housing 84 fixed to the end wall 19. A clock spring 88 is fixed at one end to the pulley extension 121 and at its other end to the spring housing 84 by fasteners 85, 86, respectively (See FIG. 9). A belt 90 is laid over and fixed at one end to the pulley 89 and has its other end fixed to strut 49 by a clamp 92 (See FIGS. 5–8).

The pulley 89 is connected to roller 57 by a free wheel coupling which, when the pulley 89 rotates in a clockwise direction, as seen in FIGS. 6–8, allows the roller 57 to idle and not rotate. When the pulley 89 rotates in the opposite direction, i.e., counterclockwise as seen in FIGS. 6–8, the free wheel coupling causes the roller 57 to rotate conjointly with pulley 89. As shown in FIG. 10, a boss 91 fixed to the other side of pulley 89 extends into a hollow sleeve portion 93 of roller 57. Boss 91 is formed with a pair of recesses 99, 101 in which a pair of ratchet rollers 103, 105 are positioned. A pair of light springs 107, 109 bias the rollers 103, 105 in a direction where they frictionally engage the roller sleeve 93 when the boss 91 rotates in a counterclockwise direction and cause the pulley 89 and roller 57 to rotate together. Springs 107, 109 also allow the ratchet rollers 103, 105 to retract from frictional engagement with sleeve 93 when the boss 91 rotates in a clockwise direction so that the pulley 89 rotates freely of the roller 57.

When the container 13 is moved from the FIG. 8 position to the position shown in FIG. 6, the belt 90 unwinds from the pulley 89 and causes it to rotate in a clockwise direction as seen in these figures. This also causes the clock spring 88 to wind tightly within spring housing 84. During this time, the ratchet rollers 103, 105 ride freely within sleeve 93 and the roller 57 idles and does not rotate.

When the container returns from the FIG. 6 to the FIG. 8 position, the wound clock spring 88 rotates the pulley 89 in a counterclockwise direction and rewinds the belt 90 on pulley 89. This causes the ratchet rollers 103, 105 to frictionally engage sleeve 93 and the roller 57 to rotate with the pulley 89. The force of the unwinding clock spring 88 not only rotates the pulley 89 but also serves to assist return movement of container 13.

In accordance with the invention, means is provided to press the paper sheets 55 against the paper sheet-feeding roller 57 during that portion of container movement when a paper sheet is delivered from the container 13. As embodied herein, a bar 59 supported by pivot pins 61, 63 (FIG. 1) in the cover 21 has a depending skirt 65 which is positioned on the side of the stack of sheets 55 opposite the feed roller 57 (FIGS. 5–8). An arm 67 is fixed to and extends transversely of the bar 59. A link 69 is positioned adjacent side wall 19 of the frame 13 and has a pin 71 fixed thereto which is slidable in an elongated slot 73 in the wall 19 (See also FIG. 2). A tension spring 75 has one end attached to a projecting arm 77 on link 69 and its other end attached to tilting link 45 (FIGS. 6 and 7).

In accordance with the invention, means interconnected with the support means 12 holds the paper pressing means out of pressing engagement with the paper sheets 55. As embodied herein, latch means including a notch 79 in link 69 is positioned to engage pivot rod 33. Link 69 has a tapered surface 81 engageable with a cam 83 fixed to pivot rod 35 on the container 13.

When the container 13 moves toward its position over the toilet seat 12 shown in FIG. 6, the tapered end 81 of link 69 engages cam 83. This causes the link 69 to pivot about pin 71 and disengages the notch 79 from the pivot rod 33. Tension spring 75 then causes the link 69 to move longitudinally so that pin 71 engages arm 67 and pivots bar 59 in a direction causing skirt 65 to resiliently press the stack of paper sheets 55 toward the roller 57 and into engagement with friction surface 58.

When the container 13 returns to its FIG. 8 position, tension on spring 75 relaxes and link 69 returns by gravity to the position where notch 79 can engage pivot rod 33. Arm 67 also pivots bar 59 in a direction moving skirt 65 away from the stacked sheets 55 and roller 57 (See FIG. 8).

In use, when it is desired to apply a paper sheet 55 to a toilet seat 11, the user grasps the control lever 51 and pulls it in a downward direction, causing it to pivot counterclockwise about pivot pin 37 as seen in FIG. 3. This causes the tilting levers 29, 31, 37, 39 to also pivot in a counterclockwise direction, and the container 13 to tilt downwardly and forwardly to a position over the toilet seat 11 as shown in FIG. 6. During this motion, the pulley 89 turns in a clockwise direction but, as described above, the roller 57 idles and does not turn. Also, during this motion, link 69 has its notch 79 engaged with the pivot rod 33 so that skirt 65 is not pressed against the paper sheets 55.

When the parts approach the position substantially as shown in FIG. 6, the tapered end 81 of link 69 engages the stationary cam 83 fixed to the pivot rod 33 and causes the link notch 79 to disengage from the pivot rod 33. The link 69 then moves upwardly under the force of spring 75 and pin 71 engages arm 67 and presses the skirt 65 into engagement with the paper sheets 55 holding them against the friction surface 58 of roller 57.

When the lever 51 is then released, the clock spring 88 rewinds and turns the pulley 89 in a counterclockwise direction and causes the belt 85 to rewind on the pulley 83. Counterclockwise rotation of the pulley 89 now imparts counterclockwise rotation to the roller 57. Since the skirt 65 is biased against the paper sheets 55, the friction surface 58 of rotating roller 57 engages the bottommost sheet 55A and feeds it outwardly at the bottom of the container 13.

At the same time, the belt 85, rewinding on pulley 89, causes the container 13 to tilt upwardly and rearwardly and the tilting levers 29, 31, 37, 39 and the control lever 51 to pivot in a clockwise direction. The paper sheet 55A continues to emerge downwardly from container 13 and is laid along the top of the toilet seat 11.

As seen in FIG. 6, the emerging sheet 55A has just begun to lay across the top of the toilet seat 11. As the parts continue their retractive movement, the container 13 continues to tilt upwardly and rearwardly, and at the same time, the roller 57 rotates in a counterclockwise direction and continues to feed the paper sheet 55A along the toilet seat 11 (See FIG. 7). Ultimately, the parts reach the position shown in FIG. 8 where the container 13 is in a substantially vertical position and the paper sheet 55A is laid completely across the top of the toilet seat 11.

When the parts reach the FIG. 8 position, tension on the spring 75 is relaxed, and the link 69 moves downwardly to a position where the notch 79 can engage with the pivot rod 33. Skirt 65, under the weight of arm 79, pivots away from the stack of paper sheets 55 so that pressure by skirt 65 is not applied to the sheets 55 again until the device is actuated to deliver another sheet 55 to the toilet seat 11. This greatly reduces the likelihood that a sheet 55 will stick to the friction surface 58 of roller 57.

By the foregoing, there has been provided an improved device for applying a paper sheet to a toilet seat constructed in accordance with the principles of the invention set out hereinabove, and while a preferred embodiment has been illustrated and described in detail, it will be appreciated that various additions, substitutions, modifications, and omissions may be made thereto without departing from the spirit of the invention.

What is claimed is:

1. A device for applying a paper sheet to a toilet seat comprising a container holding a stacked supply of paper sheets fitting said toilet seat, means supporting said container adjacent said toilet seat and including a mechanism operable to move said container from a substantially vertical position rearwardly of said toilet seat to a position over said seat and for returning the container to the vertical position, a paper sheet-feeding roller journaled on said container, drive means interconnected with said support means and operable to rotate said roller during at least a portion of the movement of said container, means operable to press a paper sheet from said stacked supply against said paper sheet-feeding roller during that portion of container movement when said paper sheet is delivered from said container and applied to said toilet seat, and means responsive to the position of said support means for holding said paper sheetpressing means out of pressing engagement with said paper sheets when said container is in said substantially vertical position.

2. A device as claimed in claim 1, said sheet pressing means including a member pivotally mounted on said container, resilient means operable to pivot said pressing member toward said roller and against said stacked paper sheets, said holding means for said pressing means including latch means normally holding said resilient means out of operative engagement with said pressing member and releasable in response to movement of said container.

3. A device as claimed in claim 1, said sheet pressing means including an elongated member pivoted in said container and having a skirt extending along said stacked paper sheets, link means engageable with said elongated member, spring means interconnected with said container-moving mechanism and said link means and operable to bias said link means toward engagement with said elongated pivoted member, and latch means operable to prevent engagement between said link means and said elongated pivoted member, said latch means being releasable in response to movement of said container to permit said link means to engage said elongated pivoted member.

4. A device as defined in claim 3, said latch means including a surface on said link means engageable with means carried by said container which normally prevents movement of said link means under the force of said spring means, and cam means engageable with said link means upon movement of said container to disengage said link means surface from said container means.

5. A device as defined in claim 1, said drive means including a pulley journaled on said container, a free wheel coupling interconnecting said pulley and said roller for conjoint rotation in only one direction, means causing said pulley to rotate in one direction when said container moves from its substantially vertical position to its position over said toilet seat, and to rotate in the opposite direction during return movement of said container.

6. A device as defined in claim 5, said pulley being journaled on a stationary shaft, said means causing said pulley to rotate including a belt fixed at one end to said pulley and at its other end to said supporting means, and a clock spring interconnecting said pulley and said stationary shaft.

7. A device as defined in claim 4, said spring means being inoperable to bias said link means toward engagement with said elongated pivoted member when said container is in its substantially vertical position, and counterweight means on said elongated pivoted member causing said skirt to move away from said stacked sheets when said container is in its substantially vertical position.

8. A device as defined in claim 1, said drive means including means interconnecting said support means and said roller and operable to rotate said roller only upon movement of said container from its position over said toilet seat to its substantially vertical position, said pressing means holding means allowing said pressing means to pressingly engage said paper sheets only during movement of said container from its position over said toilet seat toward its substantially vertical position.

9. A device for applying a paper sheet to a toilet seat comprising a container holding a stacked supply of sheets fitting said toilet seat, means supporting said container adjacent said toilet seat and including a mechanism operable to move said container from a substantially vertical position rearwardly of said toilet seat to a position tilted and hinged downwardly and forwardly over said toilet seat, a paper sheet feeding roller journaled on said container, drive means interconnected with said support means and operable to rotate said roller only during return movement of said container from its position over said toilet seat to its substantially vertical position, press means in said container operable to bias a paper sheet from said stacked supply against said roller during rotation thereof, and means responsive to the position of said support means for preventing biased operative engagement of said press means with said paper sheet during other movement of said container and when said container is in its substantially vertical position.

10. A device as claimed in claim 9, said means preventing biased operative engagement of said press means with said paper sheet including latch means which is released in response to movement of said container to substantially its position over said toilet seat.

11. A device as claimed in claim 10, which includes spring means operable to bias said press means toward engagement with said paper sheet but being inoperable when said container is in its substantially vertical position.

* * * * *